US009890607B2

(12) United States Patent
Hanlin et al.

(10) Patent No.: US 9,890,607 B2
(45) **Date of Patent: *Feb. 13, 2018**

(54) INDEPENDENT GUIDE STRING HANGER

(71) Applicant: Cameron International Corporation, Houston, TX (US)

(72) Inventors: David Joseph Hanlin, Spring, TX (US); Bradley Mitchell Mandziak, Calgary (CA)

(73) Assignee: Cameron International Corporation, Houston, TX (US)

( * ) Notice: Subject to any disclaimer, the term of this patent is extended or adjusted under 35 U.S.C. 154(b) by 321 days.

This patent is subject to a terminal disclaimer.

(21) Appl. No.: 14/723,453

(22) Filed: May 28, 2015

(65) Prior Publication Data

US 2015/0376971 A1 Dec. 31, 2015

Related U.S. Application Data

(63) Continuation of application No. 14/035,892, filed on Sep. 24, 2013, now Pat. No. 9,051,808, which is a continuation of application No. 12/868,469, filed on Aug. 25, 2010, now Pat. No. 8,544,539.

(51) Int. Cl.

| | |
|---|---|
| ***E21B 33/047*** | (2006.01) |
| ***E21B 19/02*** | (2006.01) |
| ***E21B 33/04*** | (2006.01) |

(52) U.S. Cl.

CPC ..... *E21B 33/047* (2013.01); *E21B 33/0407* (2013.01)

(58) Field of Classification Search

CPC ..... E21B 33/047; E21B 19/02; E21B 33/04

See application file for complete search history.

(56) References Cited

U.S. PATENT DOCUMENTS

| | | | |
|---|---|---|---|
| 2,694,450 | A | 11/1954 | Osbun |
| 2,889,886 | A | 6/1959 | Gould |
| 3,115,934 | A | 12/1963 | Rector |
| 3,118,690 | A | 1/1964 | Watts et al. |
| 3,223,168 | A | 12/1965 | Stone |
| 3,437,149 | A | 4/1969 | Cugini et al. |
| 3,807,497 | A | 4/1974 | Baugh |

(Continued)

FOREIGN PATENT DOCUMENTS

| | | | |
|---|---|---|---|
| CA | 2137336 | A | 6/1996 |
| GB | 824421 | A | 12/1959 |

OTHER PUBLICATIONS

PCT International Search Report and Written Opinion; Application No. PCT/US2011/037997; Dated Jan. 16, 2013; 15 pages.

(Continued)

*Primary Examiner* — Kenneth L Thompson

(74) *Attorney, Agent, or Firm* — Fletcher Yoder, P.C.

(57) ABSTRACT

A system, in certain embodiments, includes a casing head and a tubing hanger disposed within the casing head and supported by a first retaining feature of the casing head. The tubing hanger is configured to support a tubing string. The system also includes a guide string hanger disposed within the casing head and supported by a second retaining feature of the casing head independent of the first retaining feature. The guide string hanger is configured to support a guide string.

29 Claims, 7 Drawing Sheets

(56) References Cited

U.S. PATENT DOCUMENTS

| | | | | |
|---|---|---|---|---|
| 4,090,565 | A * | 5/1978 | McGee | E21B 33/047 166/379 |
| 4,214,778 | A | 7/1980 | Diehl | |
| 4,289,199 | A | 9/1981 | McGee | |
| 4,708,201 | A | 11/1987 | Reed | |
| RE34,071 | E * | 9/1992 | Van Bilderbeek | E21B 33/043 166/342 |
| 5,148,865 | A | 9/1992 | Reed | |
| 5,775,420 | A | 7/1998 | Mitchell et al. | |
| 5,794,693 | A | 8/1998 | Wright et al. | |
| 5,795,169 | A | 8/1998 | Reed | |
| 6,015,009 | A | 1/2000 | Allen | |
| 6,015,015 | A | 1/2000 | Luft et al. | |
| 6,688,386 | B2 | 2/2004 | Cornelssen et al. | |
| 6,736,208 | B2 | 5/2004 | Riddell et al. | |
| 6,736,212 | B2 | 5/2004 | Liew | |
| 8,544,539 | B2 * | 10/2013 | Hanlin, Jr. | E21B 33/0407 166/85.5 |
| 8,567,489 | B2 | 10/2013 | Vanderford et al. | |
| 9,051,808 | B2 * | 6/2015 | Hanlin | E21B 33/0407 |
| 9,273,530 | B2 * | 3/2016 | Vanderford | E21B 33/03 |
| 2003/0196792 | A1 | 10/2003 | Riddell et al. | |
| 2004/0231835 | A1 | 11/2004 | Thai et al. | |
| 2014/0060855 | A1 | 3/2014 | Vanderford et al. | |

OTHER PUBLICATIONS

PCT Communication—Invitation to Pay Additional Fees; Application No. PCT/US2011/037997; Dated Nov. 5, 2012; 7 pages.
Canadian Office Action for CA Application No. 2,807,770, dated Feb. 7, 2017; 3 Pages.

* cited by examiner

INDEPENDENT GUIDE STRING HANGER

CROSS REFERENCE TO RELATED APPLICATION

This application claims priority to U.S. Non-Provisional patent application Ser. No. 14/035,892, entitled "Independent Guide String Hanger", filed on Sep. 24, 2013, which is herein incorporated by reference in its entirety, and which claims priority to and benefit of U.S. Non-Provisional patent application Ser. No. 12/868,469, entitled "Independent Guide String Hanger", filed on Aug. 25, 2010, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
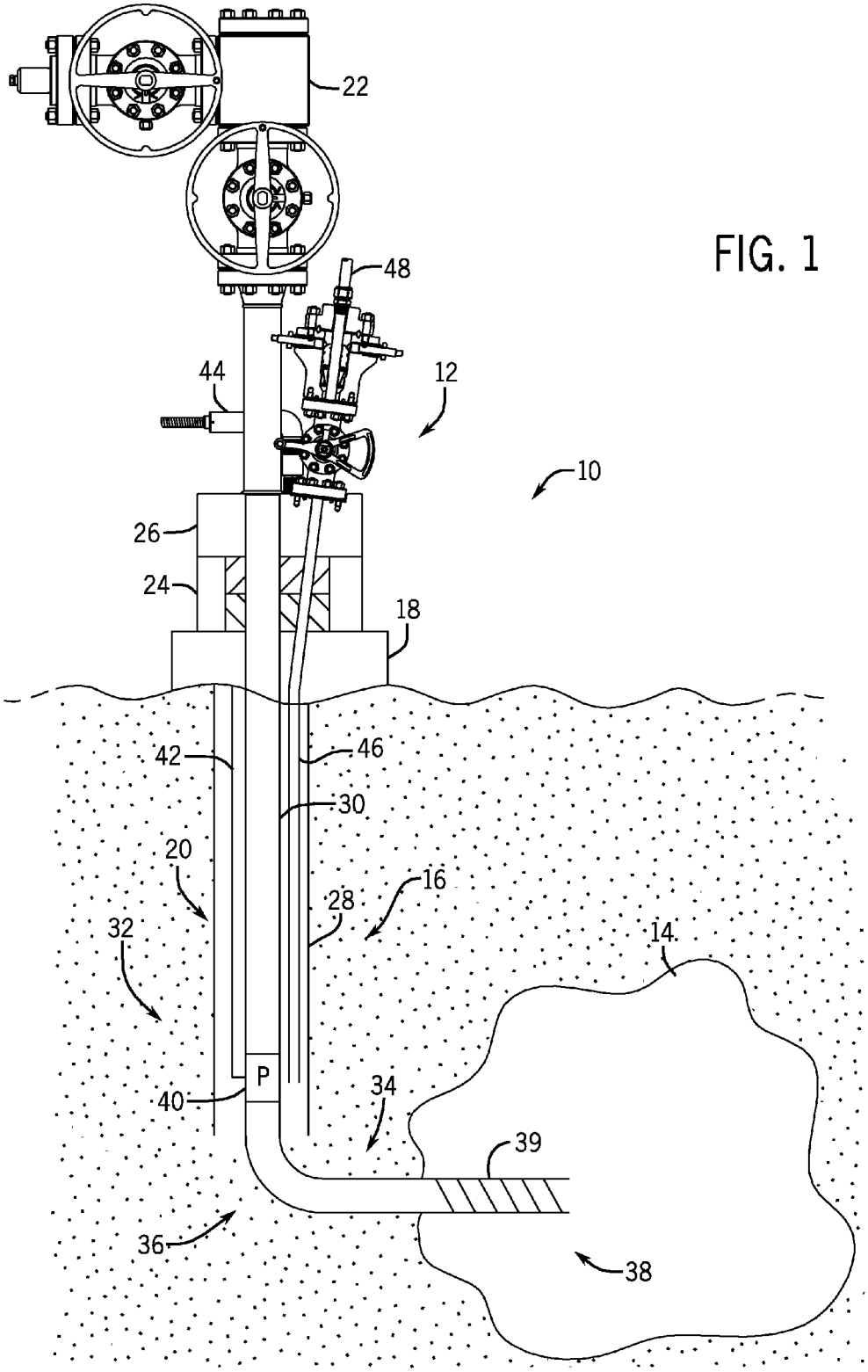
FIG. 1 is a block diagram that illustrates an exemplary mineral extraction system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain regions of the world include geologic formations which contain a mixture of heavy, viscous oil mixed with sand, known as oil sands or tar sands. Due to the thickness of the oil and the sand contamination, the oil may not be extracted through conventional production techniques. Instead, a steam assisted gravity drain (SAGD) system may be employed to separate the oil from the sand and to reduce the oil viscosity prior to extraction. In certain SAGD systems, steam is injected through a wellhead into the geologic formation containing the oil sands. The well is then shut in for a period of time (e.g., several months) allowing the oil to "heat soak." After the soaking period, the well is opened such that the heated oil and condensed steam may be extracted. Such a configuration may facilitate economically feasible oil production from oil sands.

Certain SAGD wellheads are configured to support multiple strings within a casing head. For example, a production tubing string and a guide string may be supported by a single hanger disposed within the casing head. The production tubing may extend into the oil formation and convey extracted oil to the surface, while the guide string may be used to run coiled tubing through the well casing. As will be appreciated, the hanger will include seals configured to block a flow of high pressure and high temperature steam from exiting the wellhead. Specifically, the hanger generally includes a large radial seal area for sealing both the production tubing string and the guide string. As a result, sufficient radial area may not be available for sealing additional components passing through the hanger (e.g., an electrical feed-through mandrel). Consequently, the additional components may be sealed within other areas of the wellhead (e.g., a tubing head adapter). Unfortunately, such configurations typically result in large, complex and expensive wellhead assemblies.

Embodiments of the present disclosure may significantly reduce the size, cost and complexity of wellhead assemblies used for steam assisted gravity drain (SAGD) operations. For example, in certain embodiments, a wellhead includes a casing head having a first retaining feature configured to support a tubing hanger, and a second retaining feature configured to support a guide string hanger independently of the tubing hanger. In certain embodiments, the first retaining feature includes a tapered portion of a bore of the casing head and the second retaining feature includes a shoulder. In such embodiments, the guide string hanger may be secured to the casing head by a plug that extends through the body of the casing head into a recess within the guide string hanger, while the tubing hanger is suspended by fluid pressure above the tapered portion. To block rotation of the tubing hanger, the guide string hanger may include a neck that extends axially into a recess within the tubing hanger. In this configuration, rotation of the tubing hanger is blocked by contact between the neck and the recess, while the tubing hanger is free to translate in an axial direction. Further embodiments include a tubing head adapter secured to the casing head, and a feed-through mandrel substantially sealed to the tubing head adapter and extending through the tubing hanger and the guide string hanger. Because the tubing hanger and the guide string hanger have a sufficient radial area to facilitate passage of the mandrel, the tubing head adapter may be secured to the casing head directly adjacent to the tubing hanger and guide string hanger, thereby providing a compact wellhead. In further embodiments, the guide string hanger includes an opening having a sufficient diameter to facilitate passage of an electric submersible pump (ESP), thereby enabling the guide string hanger to be run prior to running the tubing string.

FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system). As illustrated, the system 10 includes a wellhead 12 coupled to a mineral deposit 14 via a well 16, wherein the well 16 includes a surface conductor pipe 18 and a well-bore 20. The surface conductor pipe 18 provides for the connection of the wellhead 12 to the well 16.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, enable monitoring conditions in the well 16 and provide for injecting chemicals into the well-bore 20 (down-hole). In the illustrated embodiment, the wellhead 12 includes a production tree 22, a casing head 24 and a tubing head adapter 26. The system 10 may include other devices that are coupled to the wellhead 12, and devices that are used to assemble and control various components of the wellhead 12. For example, as discussed in detail below, a tubing hanger and a guide string hanger may be disposed within the casing head 24 and configured to support a production tubing string and a guide string, respectively.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore which provides for completion and workover procedures, such as the insertion of tools into the well 16, the injection of steam and various chemicals into the well 16 (down-hole), and the like. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) may also be included, either as a part of the tree 22 or as a separate device. The BOP may consist of a variety of valves, fittings and controls to prevent oil, gas, or other fluid from exiting the well in the event of an unintentional release of pressure or an overpressure condition.

In the present configuration, the well-bore 20 includes a surface casing 28 extending vertically downward from the surface conductor pipe 18. As illustrated, production tubing 30 extends through the surface casing 28 from the wellhead 12 to the mineral deposit 14. The production tubing 30 includes a substantially vertical portion 32 and a substantially horizontal portion 34. The substantially vertical portion 32 extends from the surface to the approximate depth of the mineral deposit 14, while the substantially horizontal portion 34 engages the mineral deposit 14. As a result of this geometry, the production tubing 30 includes a heel 36 which forms an approximately 90 degree bend between the substantially vertical portion 32 and the substantially horizontal portion 34. In addition, a toe 38 is positioned at the opposite end of the substantially horizontal portion 34 from the heel 36. As illustrated, the toe 38 engages the mineral deposit, thereby enabling product to flow into the well-bore 20. In addition, the horizontal portion 34 of the production tubing 30 which engages the mineral deposit 14 includes a pickup liner 39 having multiple slots configured to facilitate increased product flow into the production tubing 30.

The present mineral extraction system 10 may be utilized for SAGD operations. In such operations, steam is injected through the wellhead 12 into the geologic formation containing the mineral deposit 14, such as oil sands. The well is then shut in for a period of time (e.g., several months) allowing the oil to "heat soak." After the soaking period, the well is opened such that the heated oil and condensed steam may be extracted. However, because the oil may still be substantially viscous, an artificial lift pump, such as the illustrated electric submersible pump (ESP) 40, may be employed to transfer oil from the mineral deposit 14 to the wellhead 12. In certain SAGD configurations, the ESP 40 is positioned within the production tubing 30 adjacent to the heel 36.

As will be appreciated, an ESP conduit 42 may extend through the surface casing 28 to provide electrical power to the ESP 40. As discussed in detail below, the ESP conduit 42 passes through the wellhead 12, from an electrical feed-through connector 44 to the well-bore 20. In the present configuration, the electrical feed-through connector 44 includes a mandrel configured to mount directly to the tubing head adapter 26, thereby establishing a seal between the conduit 42 and the wellhead 12. Because the present guide string hanger includes an opening configured to accommodate the diameter of the electrical feed-through connector 44, the present wellhead 12 may have a smaller vertical extent than configurations in which the mandrel is positioned above the guide string hanger.

For example, certain hangers are configured to support and seal the production tubing 30 and guide string. Due to the high pressures and temperatures associated with SAGD production, the seals may utilize a relatively large radial area of the hanger. For example, the seals may be configured to resist a pressure of greater than approximately 2000, 2500, 3000 psi, or more, and a temperature of greater than approximately 550, 600, 650 degrees Fahrenheit, or more. Consequently, due to the large radial area of the seals, insufficient area may remain to accommodate the diameter of the mandrel. As a result, the mandrel may be positioned above the hanger such that only the conduit 42 extends through the hanger. Because the entire mandrel is positioned above the hanger, the wellhead may have a large vertical extent. In certain embodiments of the present disclosure, separate hangers are employed to support and seal the production tubing 30 and the guide string, thereby increasing the available radial area of each hanger. As a result, the mandrel may pass through the tubing hanger and the guide string hanger. Consequently, the mandrel may be secured directly to the tubing head adapter 26, thereby decreasing the vertical extent of the wellhead 12 and substantially reducing wellhead manufacturing costs.

In addition to the production tubing 30 and the ESP conduit 42, a guide string 46 may extend through the surface casing 28. As will be appreciated, the guide string 46 may be configured to facilitate running coiled tubing through the wellhead 12 and into the surface casing 28. The coiled tubing may be utilized for gas lift, catalyst injection, temperature and/or pressure monitoring, among other uses. Based on the application, the coiled tubing and guide string 46 may extend to the heel 36, the toe 38, or other region adjacent to the production tubing 30. The coiled tubing also passes through the wellhead 12 and couples to a valve 48 configured to regulate flow of various fluids through the coiled tubing. As illustrated, the valve 48 is directly coupled to the tubing head adapter 26. As previously discussed, the vertical extent of the wellhead 12 may be reduced due to the increased radial seal area generated by employing an independent guide string hanger. Consequently, the "toad stool" or extension utilized to couple the valve to the tubing head adapter employed in other wellhead configurations due to geometric limitations may be obviated.

As discussed in detail below, certain embodiments of the present wellhead configuration employ a guide string hanger that is independent of the tubing hanger. In such embodiments, the tubing hanger may be supported within the casing head 24 by a first retaining feature, and the guide string hanger may be supported by a second retaining feature of the casing head 24. For example, the guide string hanger may be supported by a shoulder, while the tubing hanger is suspended above the guide string hanger by a tapered portion of the casing head 24 or a second shoulder. In certain embodiments, the guide string hanger may include a recess disposed in an outer radial surface and configured to interface with a plug removably coupled to the casing head 24. Contact between the plug and the recess may block axial translation and circumferential rotation of the guide string hanger. Furthermore, circumferential rotation of the tubing hanger may be blocked by contact between a neck extending axially upward from the guide string hanger and a corresponding recess within the tubing hanger. Moreover, due to the length of the neck, the tubing hanger may translate in the axial direction without disengaging the guide string hanger. In further embodiments, the guide string hanger may have openings sufficiently large to facilitate passage of the production tubing 30 with the ESP conduit 42 attached. In such embodiments, the guide string 46 may be run prior to running the production tubing 30. In addition, the guide string hanger may include a threaded connection that enables the guide string hanger to be run with a segment of guide string, thereby decreasing the operational costs associated with the running process.

Figure 2:
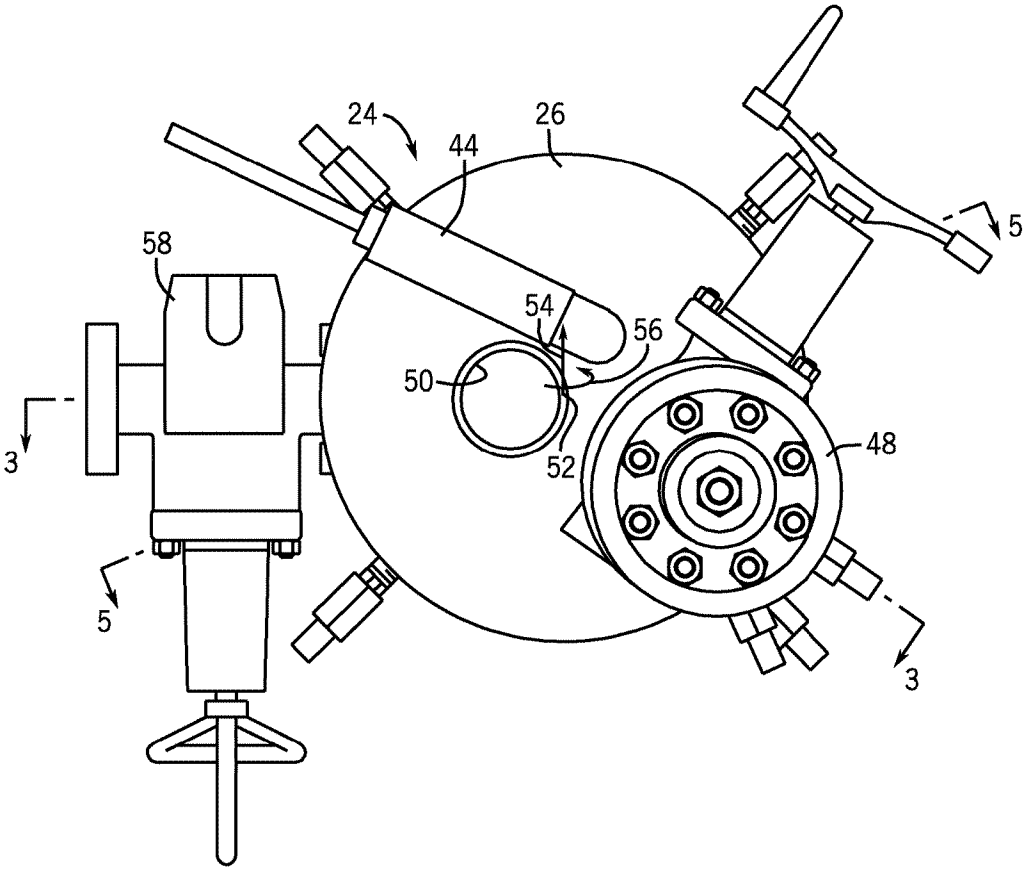
FIG. 2 is a top view of an exemplary wellhead that may be used in the mineral extraction system of FIG. 1.

FIG. 2 is a top view of an exemplary wellhead 12 that may be used in the mineral extraction system 10 of FIG. 1. As illustrated, both the valve 48 and the electrical feed-through connector 44 are coupled to the tubing head adapter 26. In addition, a tubing bore 50 extends through the tubing head adapter 26 and the casing head 24. As discussed in detail below, the tubing bore 50 is configured to establish fluid communication between the production tubing 30 and the tree 22. In the present configuration, the bore 50, the valve 48 and the electrical feed-through connector 44 are offset relative to a geometric center 52 of the casing head 24. Specifically, the components 44, 48 and 50 are offset in a radial direction 54 relative to the geometric center 52, and a circumferential direction 56 relative to one another. As discussed in detail below, this radial and circumferential offset is particularly configured to facilitate passage and sealing of the production tubing 30, the ESP mandrel, and guide string 46. Furthermore, an annulus valve 58 is coupled to an outer surface of the casing head 24 to facilitate passage of fluid between the annulus and an exterior of the wellhead 12.

Figure 3:
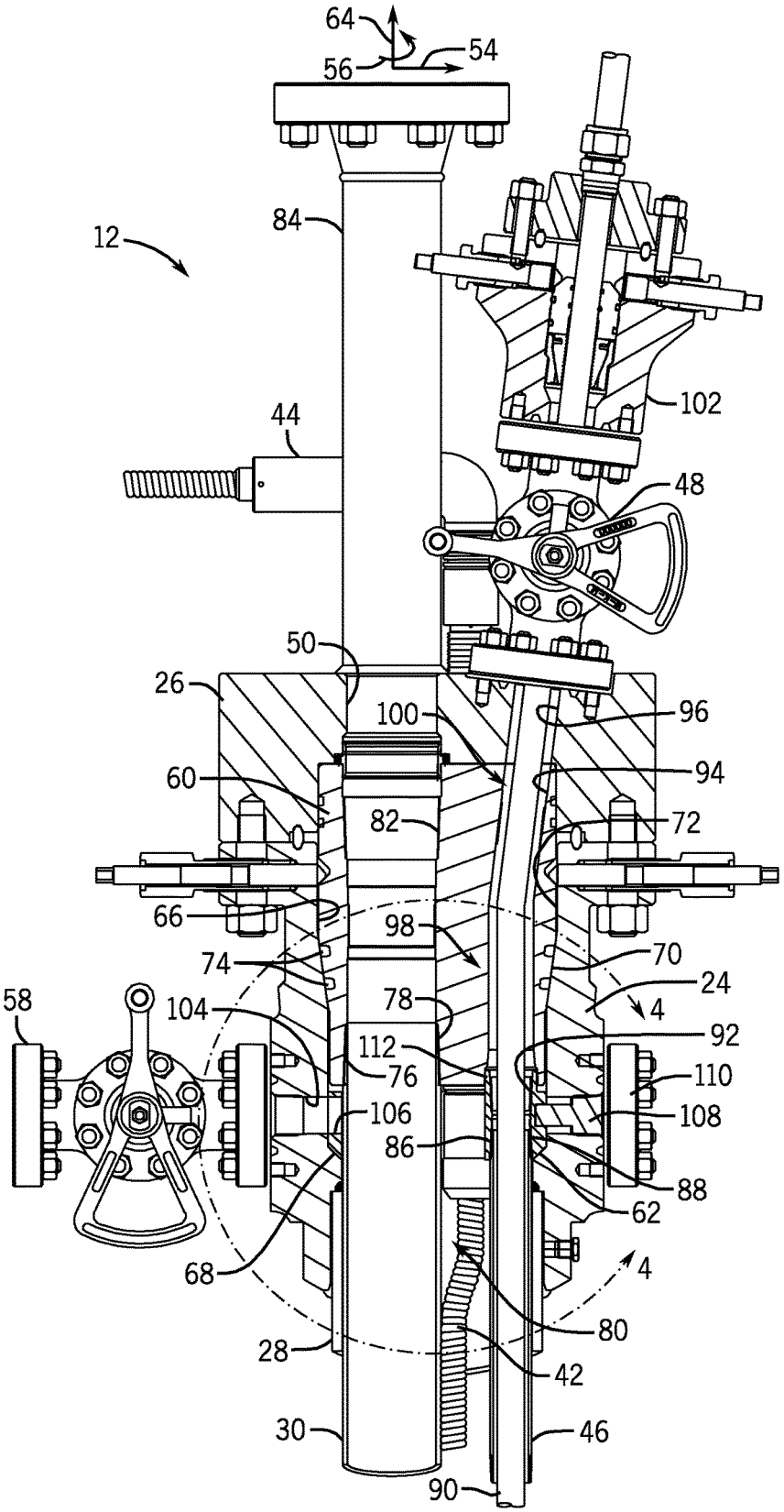
FIG. 3 is a cross-sectional view of the wellhead, taken along line 3-3 of FIG. 2, having a tubing hanger and an independent guide string hanger.

FIG. 3 is a cross-sectional view of the wellhead 12, taken along line 3-3 of FIG. 2, having a tubing hanger 60 and an independent guide string hanger 62 disposed within the casing head 24. As illustrated, the casing head 24 is configured to facilitate passage of the production tubing 30, the ESP conduit 42 and the guide string 46. In the present embodiment, the wellhead 12 includes a tubing hanger 60 and an independent guide string hanger 62. The tubing hanger 60 is configured to support the production tubing 30, and the guide string hanger 62 is configured to support the guide string 46. As illustrated, the tubing hanger 60 and the guide string hanger 62 are aligned along an axial direction 64 within a bore 66 of the casing head 24. In addition, the tubing hanger 60 and the guide string hanger 62 are vertically stacked, with the tubing hanger 60 above the guide string hanger 62. As discussed in detail below, the guide string hanger 62 is supported by a shoulder 68 of the casing head bore 66. Furthermore, the tubing hanger 60 is supported by a tapered portion 70 of the casing head 24. Specifically, a tapered portion 72 of the tubing hanger 60 is configured to interface with the tapered portion 70 of the casing head 24, thereby supporting the tubing hanger 60 in the axial direction 64. It should be appreciated that the tubing hanger 60 may be supported by other retaining features in alternative embodiments. For example, in certain embodiments, the casing head bore 66 may include a shoulder configured to support the tubing hanger 60. In the present embodiment, a pair of seals 74 (e.g., rubber o-rings) is disposed between the tubing hanger 60 and the bore 66 to block a flow of fluid between the hanger 60 and casing head 24. While two seals 74 are employed in the present embodiment, it should be appreciated that alternative embodiments may employ more or fewer seals 74, such as 1, 2, 3, 4, 5, 6, or more.

In certain configurations, the production tubing 30 includes a threaded end 76 configured to interface with corresponding threads 78 of the tubing hanger 60. The threaded connection enables the tubing hanger 60 to support the production tubing 30, and serves to substantially block fluid from flowing out of the production tubing 30 and into an annulus 80. Consequently, fluid from the mineral deposit 14 may be directed through the production tubing 30, and into a bore 82 of the tubing hanger 60. The fluid may then flow through the bore 50 of the tubing head adapter 26, and into a conduit 84 which couples the tubing head adapter 26 to the production tree 22. As a result of this configuration, fluid may be directed from the mineral deposit 14 to the tree 22 without significant leakage.

Similar to the threaded connection described above, the guide string 46 may include a threaded end 86 configured to interface with corresponding threads 88 of the guide string hanger 62. The threaded connection enables the guide string hanger 62 to support the guide string 46, while substantially blocking fluid flow between the guide string 46 and the annulus 80. As previously discussed, the guide string 46 is configured to facilitate running coiled tubing 90 through the wellhead 12 and into the surface casing 28. The coiled tubing 90 may be utilized for gas lift, catalyst injection, temperature and/or pressure monitoring, among other uses. As illustrated, the coiled tubing 90 extends through the guide string 46, and passes through an opening 92 within the guide string hanger 62. The coiled tubing 90 then extends through an opening 94 within the tubing hanger 60, and an opening 96 within the tubing head adapter 26. Finally, the coiled tubing 90 couples to the valve 48 configured to regulate fluid flow through the coiled tubing 90.

As illustrated, the opening 94 within the tubing hanger 60 includes a substantially straight portion 98 aligned with the axial direction 64, and an angled portion 100, extending between the substantially straight portion 98 and the valve 48. In the present configuration, the valve 48 is directly mounted to the tubing head adapter 26 at an angle configured to provide clearance between the conduit 84 and the valve 48/coiled tubing slip assembly 102. Consequently, the angle of the angled portion 100 is selected to substantially correspond to the angle of the valve 48 and slip assembly 102. For example, the angle may be approximately between 0 to 15, 2 to 10, or typically about 3 to 8 degrees.

In certain wellhead configurations which employ a single production tubing/guide string hanger, a tubing head body adapter is positioned between the casing head and the tubing head adapter. As will be appreciated, the tubing head body adapter is configured to provide clearance between the electrical feed-through mandrel and the hangers, and to align the ESP conduit, the production tubing and the guide string. In such configurations, the coiled tubing valve is mounted to the tubing head body adapter by an angled extension or "toad stool." The toad stool serves to offset the valve and slip assembly from the tubing head body adapter. As discussed in detail below, the present embodiment obviates the tubing head body adapter because the electrical feed-through connector 44 mounts directly to the tubing head adapter 26 due to the additional radial seal area provided by the independent guide string hanger 62. As a result, the toad stool which serves to offset the valve and slip assembly from the tubing head body adapter is obviated. Consequently, the valve 48 may be mounted directly to the tubing head adapter 26, thereby decreasing the size, complexity and manufacturing costs associated with the present wellhead 12.

As illustrated, the annulus valve 58 is mounted to a first radial side of the casing head 24. As previously discussed, the valve 58 is configured to regulate a flow of fluid between the annulus 80 and external conduits, pipes and/or downstream components. In the present configuration, a fluid passage 104 within the casing head 24 extends between the valve 58 and the bore 66. In addition, a passage 106 within the guide string hanger 62 is aligned with the casing head passage 104 such that fluid may flow between the annulus 80 and the valve 58 via the passages 104 and 106. A plug 108 is secured to the opposite radial side of the casing head 24 by a flanged connection 110. The plug 108 is configured to interface with the guide string hanger 62 to block movement of the hanger 62 in the axial direction 64, and to block rotation of the hanger 62 in the circumferential direction 56. As discussed in detail below, the guide string hanger 62 includes a neck 112 configured to interface with the tubing hanger 60 to block rotation of the hanger 60 in the circumferential direction 56 and/or to establish a seal with the hanger 60.

As discussed in detail below, the guide string hanger 62 includes openings sufficiently large to facilitate passage of the production tubing 30 with the ESP conduit 42 attached (e.g., strapped to the production tubing 30). In this configuration, the guide string 46 may be run prior to running the production tubing 30. In addition, the guide string hanger 62 may include a threaded connection that enables the guide string hanger to be run with a segment of guide string, thereby decreasing the operational costs associated with the running process. Moreover, because the guide string hanger 62 and the tubing hanger 60 include openings sufficiently large to facilitate passage of the electrical feed-through mandrel, the mandrel may be sealed to the tubing head adapter 26, thereby substantially decreasing the vertical extent of the wellhead 12 compared to configurations in which the mandrel is positioned above the tubing hanger and guide string hanger.

Figure 4:
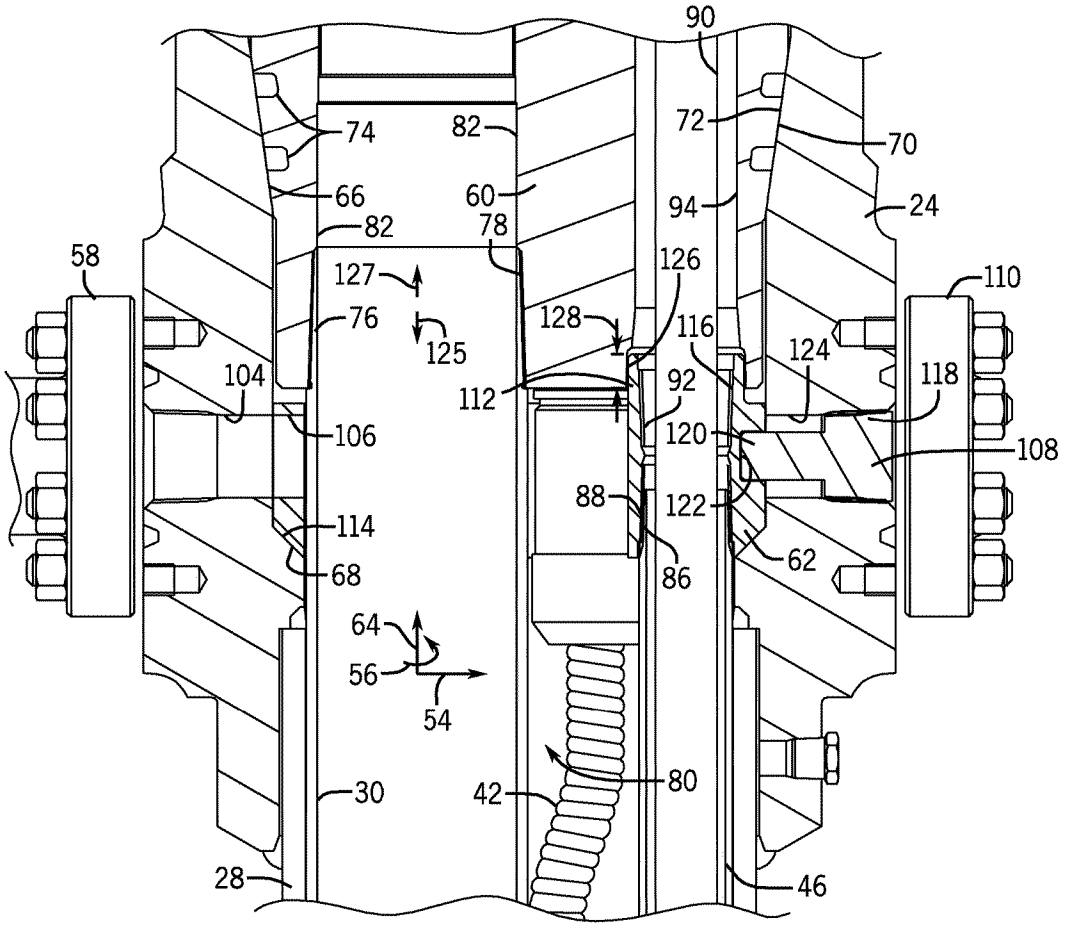
FIG. 4 is a detailed cross-sectional view of the independent guide string hanger, taken within line 4-4 of FIG. 3.

FIG. 4 is a detailed cross-sectional view of the independent guide string hanger 62, taken within line 4-4 of FIG. 3. As illustrated, the guide string hanger 62 is supported by the shoulder 68 of the casing head 24. As will be appreciated, the shoulder 68 is configured to support a wear bushing which may be present during drilling operations. By utilizing the existing shoulder 68 to support the guide string hanger 62, the present embodiment may be implemented with substantially no modifications to the casing head 24. In the present configuration, the guide string hanger 62 includes an angled (e.g., tapered) portion 114 configured to substantially match the contour of the shoulder 68. In this manner, movement of the guide string hanger 62 in the axial and radial directions 64 and 54 will be blocked by contact between the angled portion 114 and the shoulder 68.

To facilitate running (e.g., lowering) the guide string hanger 62 into the illustrated installed position, the opening 92 includes an upper threaded end 116. Similar to the lower threaded end 88, the upper threaded end 116 is configured to interface with corresponding threads of a guide string segment. In such a configuration, prior to installation, a guide string segment may be secured to the guide string hanger 62 via the upper threaded end 116. Next, the guide string hanger 62 may be run into the casing head bore 66 by lowering the guide string segment until the angled portion 114 of the guide string hanger 62 contacts the shoulder 68. At that point, the guide string segment may be uncoupled from the guide string hanger 62 and removed from the casing head bore 66. In this manner, the present guide string hanger 62 may be run without special tools, thereby decreasing the operational costs associated with the running process.

As previously discussed, once the guide string hanger 62 has been lowered into position, the hanger 62 may be secured by the plug 108. As illustrated, the plug 108 includes a larger diameter end 118 coupled to the flanged connection 110, and a smaller diameter end 120 configured to engage the guide string hanger 62. Specifically, the guide string hanger 62 includes a recess 122 located at one circumferential position along an outer radial surface of the guide string hanger 62. The recess 122 is shaped to substantially correspond to the shape of the smaller diameter end 120. Consequently, after the guide string hanger 62 has been lowered into position, the recess 122 may be aligned with a passage 124 within the casing head 24. The plug 108 may then be inserted into the passage 124 such that the smaller diameter portion 120 engages the recess 122. After engagement, the plug 108 may be secured to the casing head 24 by the flanged connection 110. As a result of this configuration, movement of the guide string hanger 62 in the axial direction 64 and rotation of the hanger 62 in the circumferential direction 56 are blocked by contact between the smaller diameter portion 120 and the recess 122.

Furthermore, the guide string hanger 62 is configured to block rotation of the tubing hanger 60 in the circumferential direction 56. As previously discussed, the guide string hanger 62 includes a neck 112 located at one circumferential position along an upper axial surface of the guide string hanger 62. In addition, the tubing hanger 60 includes a recess 126 located at one circumferential position along a lower axial surface of the tubing hanger 60. In this configuration, as the tubing hanger 60 is run into the casing head bore 66, the recess 126 may be aligned with the neck 112 such that the neck 112 engages the recess 126. Once the tubing hanger 60 is in the illustrated installed position, rotation of the hanger 60 in the circumferential direction 56 is blocked by contact between the neck 112 and the recess 126. Because rotation of the guide string hanger 62 is blocked by the plug 108, the tubing hanger 60 may not rotate relative to the casing head 24. As discussed in detail below, the neck 112 may include a seal which contacts the recess 126 to block fluid flow between the annulus 80 and the opening 94.

As previously discussed, movement of the tubing hanger 60 in an axially downward direction 125 is blocked by contact with the bore 66 of the casing head 24. Specifically, the tapered portion 72 of the tubing hanger 60 is configured to interface with the tapered portion 70 of the casing head 24, thereby supporting the tubing hanger 60 in the axial direction 64. In addition, the pair of seals 74 (e.g., rubber o-rings or graphite yarn) disposed between the tubing hanger 60 and the bore 66 substantially block flow fluid between the hanger 60 and casing head 24. In this configuration, the tubing hanger 60 may "float" or move in an axially upward direction 127 due to hydraulic fluid pressure between the hanger 60 and the casing head 24. As illustrated, the neck 112 is positioned a distance 128 within the recess 126. Consequently, the tubing hanger 60 may translate in the axially upward direction 127 a distance substantially equal to the overlap 128 between the neck 112 and the recess 126, while blocking rotation of the tubing hanger 60.

While the tubing hanger 60 is supported by the tapered portion 70 of the casing head 24 in the present embodiment, it should be appreciated that the tubing hanger 60 may be supported by other retaining features in alternative embodiments. For example, in certain embodiments, the casing head bore 66 may include a shoulder configured to support the tubing hanger 60. In such embodiments, the tubing hanger 60 may be locked into the lowered position by pins, for example. As a result, movement of the tubing hanger 60 in the axially upward direction 127 will be blocked, thereby substantially reducing or eliminating the float described above.

As discussed in detail below, the guide string hanger 62 includes openings sufficiently large to facilitate passage of the production tubing 30 with the ESP conduit 42 attached (e.g., strapped to the production tubing 30). In this configuration, the guide string 46 may be run prior to running the production tubing 30. In addition, because the guide string hanger 62 and the tubing hanger 60 include openings sufficiently large to facilitate passage of the electrical feed-through mandrel, the mandrel may be sealed to the tubing head adapter 26, thereby substantially decreasing the vertical extent of the wellhead 12 compared to configurations in which the mandrel is positioned above the tubing hanger 60 and guide string hanger 62.

Figure 5:
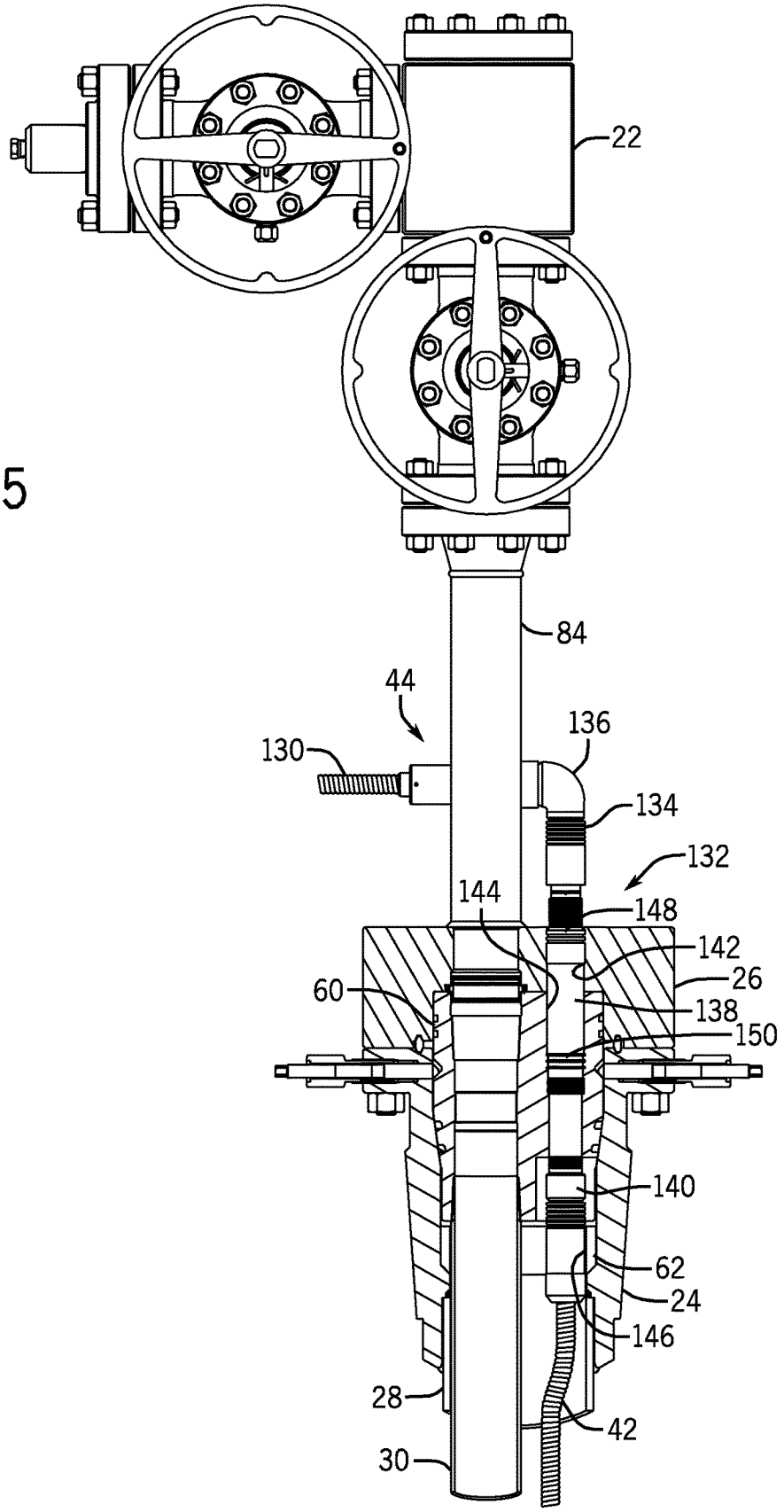
FIG. 5 is a cross-sectional view of the wellhead, taken along line 5-5 of FIG. 2, showing an electrical feed-through mandrel passing through the tubing hanger.

FIG. 5 is a cross-sectional view of the wellhead 12, taken along line 5-5 of FIG. 2, showing an electrical feed-through mandrel passing through the tubing hanger 60. As illustrated, the electrical feed-through connector 44 includes an electrical conduit 130 configured to deliver electrical power to the ESP 40 via the down-hole conduit 42. The electrical feed-through connector 44 also includes a substantially rigid, cylindrical housing 132 configured to block a flow of high pressure and high temperature steam from exiting the wellhead 12. In the present embodiment, the cylindrical housing 132 includes an upper connection 134 having an angled neck 136, a mandrel 138 extending through the tubing head adapter 26 and tubing hanger 60, and a lower connector 140 extending through the guide string hanger 62. In certain embodiments, the electrical feed-through connector 44 may include a BIW connector manufactured by ITT Corporation of White Plains, N.Y.

In certain embodiments, the upper connector 134 and the lower connector 140 may be coupled to the mandrel 138 via respective threaded connections. For example, external threads may be disposed on each axial side of the mandrel 138. The upper connector 134 and the lower connector 140 may include corresponding internal threads configured to interface with the external threads of the mandrel 138. In such a configuration, the upper connector 134 and the lower connector 140 may be coupled to the mandrel 138 via rotation of the respective connector 134 and/or 140, or rotation of a sleeve coupled to the respective connector 134 and/or 140 and including the internal threads. The upper connector 134 and/or the lower connector 140 may include electrical stabs or prongs configured to engage corresponding receptacles in the mandrel 138, thereby establishing an electrical connection between the external electrical conduit 130 and the down-hole conduit 42.

As illustrated, the mandrel 138 extends through an opening 142 within the tubing head adapter 26 and an opening 144 within the tubing hanger 60. Similarly, the lower connector 140 extends through an opening 146 within the guide string hanger 62. In the present configuration, the outer diameter of the mandrel 138 is substantially equal to the inner diameter of the openings 142 and 144. In addition, a first seal (e.g., multiple rubber o-rings) 148 may be disposed between the mandrel 138 and the tubing head adapter 26, and a second seal (e.g., multiple rubber o-rings) 150 may be disposed between the mandrel 138 and the guide string hanger 60. Consequently, the mandrel 138 may serve to substantially block a flow of steam out of the wellhead 12, while establishing an electrical connection with the ESP 40.

Figure 6:
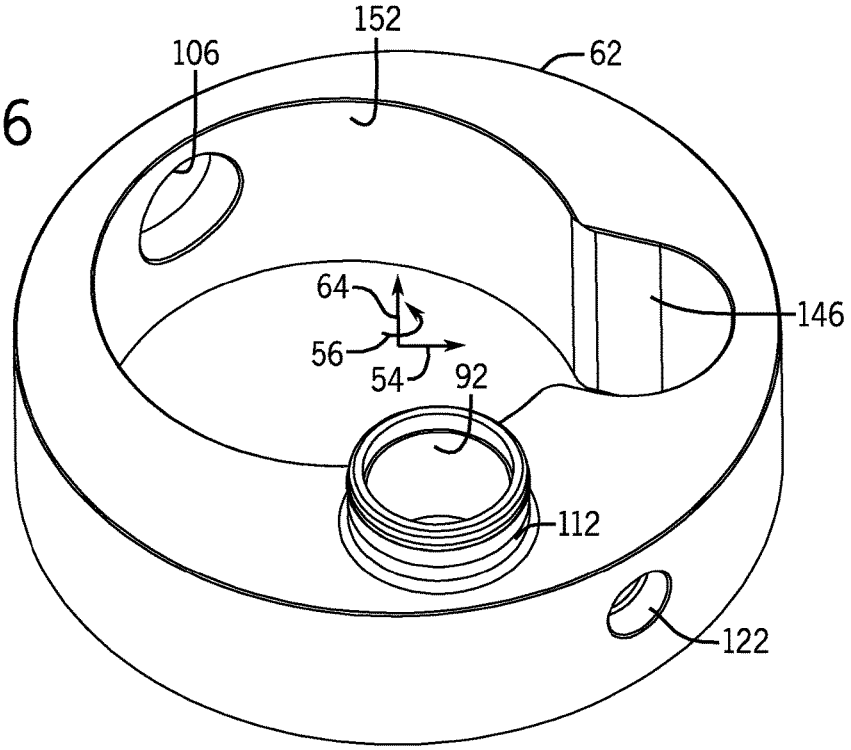
FIG. 6 is a perspective view of an embodiment of the independent guide string hanger, as shown in FIG. 2.

FIG. 6 is a perspective view of the independent guide string hanger 62, as shown in FIG. 2. As illustrated, the guide string hanger 62 includes the passage 106 configured to establish fluid communication between the valve 58 and the annulus 80. In addition, the guide string hanger 62 includes the recess 122 configured to interface with the plug 108 to block rotation and translation of the guide string hanger 62 relative to the casing head 24. While a substantially round recess 122 is employed in the present embodiment, it should be appreciated that alternative embodiments may employ other recess shapes (e.g., square, hexagonal, etc.) which correspond to the shape of the plug 108. Furthermore, because the recess 122 does not extend through the structure of the guide string hanger 62, fluid may not pass through the recess 122. As previously discussed, because the recess 122 is disposed on an opposite radial side of the guide string hanger 62 from the passage 106, rotating the guide string hanger 62 such that the recess 122 aligns with the plug 108 aligns the passage 106 with the passage 104 in the casing head 24. In this manner, when the plug 108 is inserted into the recess 122, the passage 106 is aligned with the passage 104, thereby establishing a fluid path between the annulus 80 and the valve 58.

In the present embodiment, the guide string hanger 62 includes an opening 152 configured to facilitate passage of the production tubing 30. As previously discussed, the production tubing 30 is coupled and sealed to the tubing hanger 60, which is vertically stacked above the guide string hanger 62 in the present embodiment. Consequently, the present guide string hanger 62 is configured to accommodate the production tubing 30 without sealing or supporting the tubing 30. The guide string hanger 62 also includes the opening 146 configured to facilitate passage of the electrical feed-through connector 44. As illustrated, the openings 146 and 152 adjoin one another without any hanger material positioned between the openings 146 and 152. Consequently, the production tubing 30 and the electrical conduit 42 may be run together without interference from the guide string hanger 62. For example, the electrical conduit 42 may be strapped to the production tubing 30 as the tubing 30 is lowered into the well-bore 20. Because the openings 152 and 146 may accommodate the combined tubing and conduit assembly, the guide string 46 may be run prior to running the tubing 30.

Figure 7:
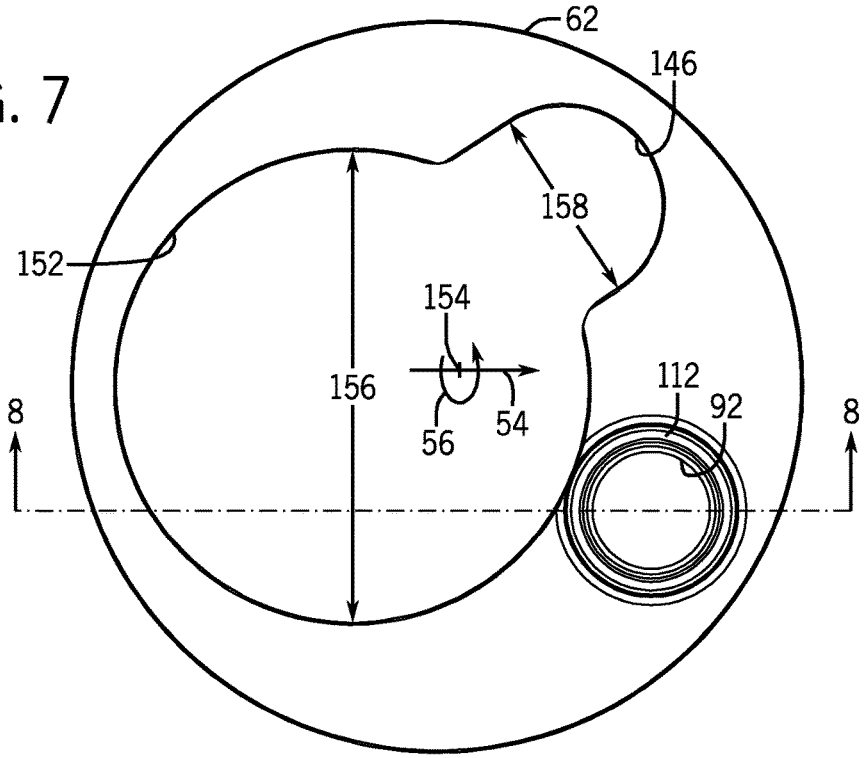
FIG. 7 is a top view of the independent guide string hanger of FIG. 6.

FIG. 7 is a top view of the independent guide string hanger 62, as shown in FIG. 2. As illustrated, the tubing opening 152, the electrical conduit opening 146 and the coiled tubing opening 92 are offset from a geometric center 154 of the guide string hanger 62 along the radial direction 54. In addition, the openings 152, 146 and 92 are offset from one another along the circumferential direction 56. Such a configuration may accommodate passage of the production tubing 30, the electrical conduit 42 and the coiled tubing 90 through the present guide string hanger 62. As previously discussed, the production tubing 30 and the electrical conduit 42 may be run simultaneously. Consequently, the combined area of the openings 152 and 146 may facilitate passage of the tubing/conduit assembly. In the present embodiment, a diameter 156 of the opening 152 is sufficient to accommodate passage of the ESP 40, and a diameter 158 of the opening 146 is sufficient to accommodate the electrical feed-through connector 44. As will be appreciated, the ESP 40 may be run along with the production tubing 30, and a diameter of the ESP 40 may be larger than a diameter of the production tubing 30. Because the diameter 156 of the production tubing opening 152 is larger than the diameter of the ESP, the guide string hanger 62 may be run (i.e., lowered into position) prior to running the production tubing 30.

While the guide string hanger 62 is configured to facilitate passage of the ESP 40, production tubing 30 and electrical conduit 42 through the openings 152 and 146, the present guide string hanger 62 includes sufficient remaining radial area to seal the guide string 46. As previously discussed, the guide string 46 includes outer threads 86 configured to interface with inner threads 88 of the guide string hanger 62. Once coupled, the threaded connection serves to support the guide string 46 and provides a seal between the interior of the guide string 46 and the annulus 80. Because the production tubing 30 is sealed to the tubing hanger 60 and the feed-through mandrel 138 is sealed to the tubing hanger 60 and tubing head adapter 26, each fluid passage extending down-hole is substantially sealed at the wellhead 12. Because the opening 146 is configured to accommodate the diameter of the electrical feed-through connector 44, the present wellhead 12 may have a smaller vertical extent than configurations in which the mandrel is positioned above the guide string hanger.

Figure 8:
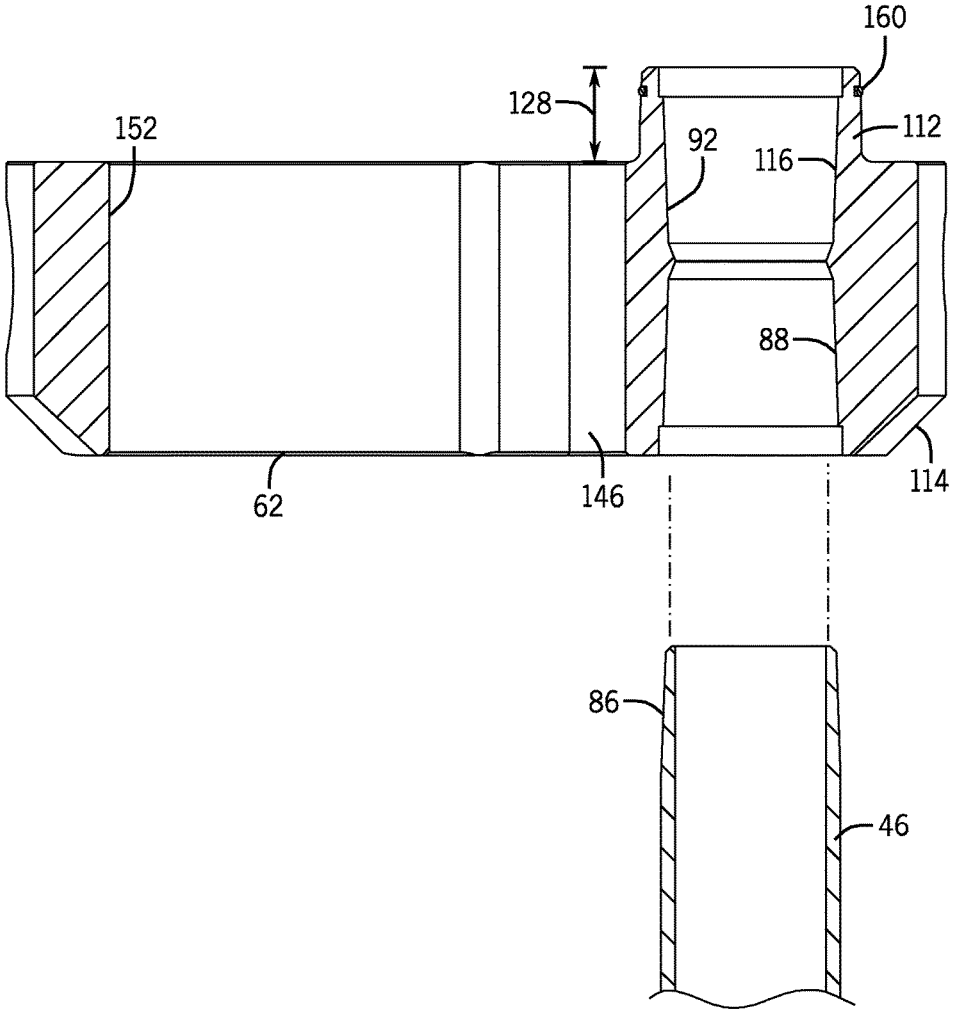
FIG. 8 is a cross-sectional side view of the independent guide string hanger and guide string, taken along line 8-8 of FIG. 7.

FIG. 8 is a cross-sectional side view of the independent guide string hanger 62 and guide string 46, taken along line 8-8 of FIG. 7. As previously discussed, the external threads 86 of the guide string 46 may be secured to the inner threads 88 of the guide string hanger 62, thereby establishing a seal between the guide string 46 and the hanger 62. Furthermore, the neck 112 of the guide string hanger 62 includes a seal 160 (e.g., rubber o-ring) configured to block fluid from flowing out of the guide string hanger 62/tubing hanger 60 connection. As previously discussed, the neck 112 of the guide string hanger 62 is configured to interface with a recess 126 in the tubing hanger 60, thereby blocking rotation of the tubing hanger 60 in the circumferential direction 56. In addition, due to the length of the neck 112, the tubing hanger 60 may float or rise in the axially upward direction 127 a distance substantially equal to the overlap 128 between the neck 112 and the recess 126. In this configuration, the seal 160 substantially blocks fluid flow into the annulus 80 despite variations in separation distance between the tubing hanger 60 and the guide string hanger 62.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a first hanger, comprising:

a hanger body; and a first passage extending through the hanger body, wherein the first passage comprises an axial passage coupled to an acutely angled passage, a first axis of the axial passage extends along a longitudinal axis of the first hanger, a second axis of the acutely angled passage extends at an acute angle relative to the longitudinal axis, and the axial passage and the acutely angled passage are both disposed in the first hanger.

2. The system of claim 1, wherein the first passage is configured to pass a first line through the first hanger.

3. The system of claim 2, wherein the first hanger comprises a second passage extending through the hanger body, and the second passage is configured to pass a second line through the first hanger.

4. The system of claim 3, wherein the first hanger comprises a third passage extending through the hanger body, and the third passage is configured to pass a third line through the first hanger.

5. The system of claim 4, wherein at least one of the first, second, or third lines comprises a tubing, and at least one of the first, second, or third lines comprise an electrical line.

6. The system of claim 1, wherein the first hanger comprises a first axial feature configured to interface with a second axial feature of a second hanger in an axially stacked configuration, and the first and second axial features, when interfaced together, block rotation of the first hanger relative to the second hanger.

7. The system of claim 1, comprising a second hanger axially stacked relative to the first hanger, wherein the first passage extends through both the first hanger and the second hanger.

8. A system comprising:

a first hanger;

a second hanger, wherein the first hanger and the second hanger are axially stacked relative to one another;

a first passage extending through the first hanger and the second hanger, wherein the first hanger is configured to support a first line;

a second passage extending through the first hanger and the second hanger, wherein the second hanger is configured to support a second line; and a third passage extending through the first hanger and the second hanger, wherein the third passage is configured to support a third line.

9. The system of claim 8, wherein each of the first, second, and third passages is offset from a centerline of the first or second hanger.

10. The system of claim 8, wherein the first hanger comprises a recess disposed within an outer radial surface, and the recess is configured to interface with a plug to block rotation and translation of the first hanger.

11. The system of claim 8, wherein the first hanger comprises a neck extending in an axial direction, and the neck is configured to interface with a recess within the second hanger to block rotation of the second hanger relative to the first hanger.

12. The system of claim 8, wherein the first line comprises first tubing, the second line comprises second tubing, and the third line comprises an electrical line.

13. The system of claim 8, wherein at least two of the first, second, or third passages intersect one another to define a common opening having a perimeter with at least two different radii.

14. A system comprising:

a first hanger comprising:

a first opening configured to facilitate passage of a first component through the first hanger, wherein the first opening has a first radius; and a second opening configured to facilitate passage of a second component through the first hanger, wherein the second opening has a second radius different than the first radius, and the first and second openings intersect one another to define a common opening having a perimeter with the first radius and the second radius.

15. The system of claim 14, comprising a second hanger vertically stacked relative to the first hanger, wherein the second hanger is configured to support the first component.

16. The system of claim 14, wherein the first hanger comprises a first axial feature configured to interface with a second axial feature of a second hanger to block rotation between the first and second hangers.

17. The system of claim 16, wherein the first axial feature comprises a neck with threads and a seal.

18. The system of claim 16, wherein the first axial feature is configured to interface with a hollow tubular portion of a line.

19. The system of claim 14, wherein the first hanger comprises a first radial feature disposed along an outer radial surface, and the first radial feature is configured to interface with a second radial feature to block rotation and translation of the first hanger.

20. The system of claim 14, wherein the first hanger comprises a third opening configured to facilitate passage of a third component through the first hanger.

21. The system of claim 20, wherein the first, second, and third openings are each offset from a centerline of the first hanger.

22. The system of claim 14, wherein the first component comprises tubing and the second component comprises an electrical line.

23. A system comprising:

a first hanger, comprising:

a hanger body; and a neck extending in an axial direction from the hanger body, wherein the neck is configured to interface with a recess within a second hanger to block rotation of the second hanger relative to the first hanger.

24. The system of claim 23, wherein the hanger body and the neck are a one-piece structure.

25. The system of claim 23, wherein the neck comprises threads.

26. The system of claim 23, wherein the neck is radially offset from a centerline of the first hanger.

27. The system of claim 23, wherein the first hanger comprises first and second openings extending axially through the hanger body and offset from a centerline of the first hanger.

28. The system of claim 23, wherein the first hanger comprises at least one tubing opening and an electrical feed opening extending axially through the hanger body.

29. The system of claim 23, wherein the first hanger comprises an asymmetrical opening extending axially through the hanger body.

* * * * *